US011857822B2

(12) United States Patent
Hsu

(10) Patent No.: US 11,857,822 B2
(45) Date of Patent: Jan. 2, 2024

(54) RECIPROCATING TRANSMISSION STRUCTURE OF EXERCISE MACHINE

(71) Applicant: GREAT FITNESS INDUSTRIAL CO., LTD., Tainan (TW)

(72) Inventor: Chih-Yung Hsu, Tainan (TW)

(73) Assignee: Great Fitness Industrial Co., Ltd., Tainan (TW)

( * ) Notice: Subject to any disclaimer, the term of this patent is extended or adjusted under 35 U.S.C. 154(b) by 6 days.

(21) Appl. No.: 17/470,320

(22) Filed: Sep. 9, 2021

(65) Prior Publication Data

US 2022/0072359 A1 Mar. 10, 2022

(30) Foreign Application Priority Data

Sep. 10, 2020 (TW) ..... 109211876

(51) Int. Cl.
*A63B 21/008* (2006.01)
*A63B 21/00* (2006.01)
(Continued)

(52) U.S. Cl.
CPC ..... *A63B 21/0088* (2013.01); *A63B 21/159* (2013.01); *A63B 21/22* (2013.01);
(Continued)

(58) Field of Classification Search
CPC ..... A63B 21/0056; A63B 21/0084; A63B 21/0088; A63B 21/159; A63B 21/22; A63B 21/225; A63B 21/4034; A63B 21/4047; A63B 22/0046; A63B 22/04; A63B 22/06; A63B 22/0605; A63B 2022/0611; A63B 2022/0617; A63B 2022/0623; A63B 2022/0629; A63B 2022/0635; A63B 2022/0641; A63B 2022/0647; A63B 2022/067; A63B 2022/0676; A63B 2022/0688
See application file for complete search history.

(56) References Cited

U.S. PATENT DOCUMENTS 7,556,591 B2 * 7/2009 Chuang ..... A63B 22/001 482/52
9,457,230 B2 * 10/2016 Giannelli ..... A63B 22/0605
(Continued)

*Primary Examiner* — Sundhara M Ganesan
*Assistant Examiner* — Zachary T Moore
(74) *Attorney, Agent, or Firm* — Rosenberg, Klein & Lee

(57) ABSTRACT

A reciprocating transmission structure of an exercise machine, mounted to a frame of the exercise machine, includes a first reciprocating member, a second reciprocating member, a main rotating wheel, a first link, a second link, and a resistance wheel. The first reciprocating member reciprocally moves with a first reciprocating pivot portion as its axis. The second reciprocating member reciprocally moves with a second reciprocating pivot portion as its axis. The first link and the second link drive the main rotating wheel to rotate with a rotating shaft as its axis. The main rotating wheel drives the resistance wheel to rotate. After the first reciprocating member and the second reciprocating member move reciprocally, the resistance wheel can be driven to rotate by the cooperation of various components. The exercise machine is suitable for performing exercises related to reciprocating movement, and the operation is easier.

7 Claims, 7 Drawing Sheets

(51) Int. Cl.
*A63B 21/22* (2006.01)
*A63B 23/04* (2006.01)

(52) U.S. Cl.
CPC ..... *A63B 21/4034* (2015.10); *A63B 21/4047* (2015.10); *A63B 23/0429* (2013.01)

(56) References Cited

U.S. PATENT DOCUMENTS

| | | | | |
|---|---|---|---|---|
| 9,636,541 | B1 * | 5/2017 | Hsu | A63B 23/10 |
| 10,806,965 | B2 * | 10/2020 | Lee | A63B 21/4035 |
| 2009/0093346 | A1 * | 4/2009 | Nelson | A63B 22/001 482/52 |
| 2015/0238807 | A1 * | 8/2015 | Long | A63B 22/001 482/52 |
| 2016/0151664 | A1 * | 6/2016 | Miller | A63B 21/225 482/52 |
| 2018/0272181 | A1 * | 9/2018 | Giannelli | A63B 23/03591 |
| 2020/0114199 | A1 * | 4/2020 | Lee | A63B 21/4035 |
| 2021/0197016 | A1 * | 7/2021 | Prosnitz | A63B 22/0012 |
| 2021/0370128 | A1 * | 12/2021 | Abelbeck | A63B 21/4033 |

* cited by examiner

RECIPROCATING TRANSMISSION STRUCTURE OF EXERCISE MACHINE

FIELD OF THE INVENTION

The present invention relates to a reciprocating transmission structure, and more particularly to a reciprocating transmission structure of an exercise machine.

BACKGROUND OF THE INVENTION

An exercise machine for arm and leg workout is commonly equipped with flywheels. Through the rotating inertia of the flywheel, the user can apply force to the exercise machine more smoothly and consistently. A conventional exercise machine is generally driven by "rotating" pedals or "rotating" grips to drive the flywheel to rotate through a transmission belt. Taiwan Utility Model Publication No. M509658 discloses a flywheel assembly drive device of an exercise bike. The flywheel assembly includes a driving wheel, a driven wheel, and a transmission belt coupled between the driving wheel and the driven wheel. The first embodiment of the drive device includes a bearing seat penetrating the middle section of the frame of the exercise machine and a flange having a short axle and a long axle. The flange is coupled between the driving wheel and the bearing seat. The short axle and the long axle pass through the center of the driving wheel and the center of the bearing seat, respectively. A left pedal unit is connected to the outer end of the long axle of the flange. The left pedal unit includes a left link and a left pedal. A right pedal unit is connected to the outer end of the short axle of the flange. The right pedal unit includes a right link and a right pedal.

However, in some cases, rotating pedals or rotating grips may not provide the most appropriate exercise for the user's alias and legs. For example, if a user wants to use the exercise machine to simulate climbing or climbing a ladder, reciprocating pedals will be more suitable than rotating pedals. Or, if the user wants to use the exercise machine to simulate rock climbing, the reciprocating grips will be more suitable than the rotating grips.

In addition, there are improved exercise machines for users to perform exercises in a reciprocating manner, for example, Taiwan Utility Model Publication No. M579544 titled "exercise device". The exercise device provides a pulling member to perform reciprocating movement. However, the pulling member is a linkage weight mechanism. When the intensity of exercise is to be changed, it is necessary to load or unload the weight block in the weight mechanism. It is inconvenient to operate.

SUMMARY OF THE INVENTION

In order to solve the above-mentioned shortcomings, the primary object of the present invention is to provide a reciprocating transmission structure of an exercise machine. The reciprocating transmission structure is mounted to a frame of the exercise machine. The reciprocating transmission structure of the exercise machine comprises a first reciprocating member, a second reciprocating member, a main rotating wheel, a first link, a second link, and a resistance wheel. The first reciprocating member includes a first reciprocating pivot portion and a first force-receiving portion that are located away from each other. The first reciprocating pivot portion is pivotally connected to the frame. A first pivot portion is provided between the first reciprocating pivot portion and the first force-receiving portion. The second reciprocating member includes a second reciprocating pivot portion and a second force-receiving portion that are located away from each other. The second reciprocating pivot portion are pivotally connected to the frame. A second pivot portion is provided between the second reciprocating pivot portion and the second force-receiving portion. The main rotating wheel is pivotally connected to the frame through a rotating shaft. The main rotating wheel includes a first face and an opposing second face. The first face is provided with a first face pivot portion at a position away from the rotating shaft. The second face is provided with a second face pivot portion at a position away from the rotating shaft. One end of the first link is pivotally connected to the first pivot portion. Another end of the first link is directly or indirectly pivoted to the first face pivot portion. One end of the second link is pivotally connected to the second pivot portion. Another end of the second link is directly or indirectly pivoted to the second face pivot portion. The resistance wheel is pivotally connected to the frame. The resistance wheel is directly or indirectly driven by the main rotating wheel. The first reciprocating member reciprocally moves with the first reciprocating pivot portion as its axis. The second reciprocating member reciprocally moves with the second reciprocating pivot portion as its axis. The first link and the second link drive the main rotating wheel to rotate with the rotating shaft as its axis. The main rotating wheel drives the resistance wheel to rotate.

Preferably, a first end of the rotating shaft extends out of the first face. The first end is secured to one end of a first arm. The first arm extends in a radial direction of the main rotating wheel. Another end of the first arm is formed with the first face pivot portion. A second end of the rotating shaft extends out of the second face. The second end is secured to one end of a second arm. The second arm extends in the radial direction of the main rotating wheel. Another end of the second arm is Ruined with the second face pivot portion.

Preferably, an included angle between the first arm and the second arm in the radial direction of the main rotating wheel is between 0° and 180°.

Preferably, the reciprocating transmission structure of the exercise machine further comprises a first rotating wheel and a second rotating wheel that are coaxially pivoted to the frame to rotate synchronously. The main rotating wheel drives the first rotating wheel through a first belt. The second rotating wheel drives a third rotating wheel through a second belt. The third rotating wheel and the resistance wheel are coaxially pivoted to the frame to rotate synchronously.

Preferably, the first force-receiving portion includes a first operating member. The first operating member is pivotally connected to the first reciprocating member. The second force-receiving portion includes a second operating member. The second operating member is pivotally connected to the second reciprocating member.

Preferably, the resistance wheel includes a resistance member. The resistance member is a magnetic resistance member or a friction member. The resistance member acts on the resistance wheel to generate a resistance.

Preferably, the resistance wheel is a wind resistance wheel.

According to the above technical features, the following effects can be achieved:

1. In the present invention, the first reciprocating member and the second reciprocating member perform reciprocating movement and drive the main rotating wheel to rotate through the reciprocating movement. The exercise machine is suitable for performing exercises related to reciprocating movement, such as reciprocating leg exercise or reciprocating arm exercise. In particular, the aforementioned reciprocating movement is transmitted to the main rotating wheel. The reciprocating movement is converted into a rotary motion. The main rotating wheel may be a flywheel or resistance wheel, or the main rotating wheel transmits power to the flywheel or resistance wheel. The resistance of the main rotating wheel, flywheel or resistance wheel can be easily controlled by means of friction resistance, magnetic resistance, wind resistance, etc., making the operation easier. This is completely different from the conventional reciprocating exercise machine that changes the intensity of exercise by increasing or decreasing weights.

2. The included angle between the first arm and the second arm in the radial direction of the main rotating wheel is between 0 degrees and 180 degrees, which can provide different reciprocating motion modes.

When the included angle between the first arm and the second arm is 0 degrees, the first reciprocating member and the second reciprocating member reciprocate synchronously. When the included angle between the first arm and the second arm is 180 degrees, the first reciprocating member and the second reciprocating member reciprocate alternately. When the included angle between the first arm and the second arm is greater than 0 degrees and less than 180 degrees, the first reciprocating member and the second reciprocating member reciprocate alternately and asymmetrically.

DESCRIPTION OF THE PREFERRED EMBODIMENTS

Embodiments of the present invention will now be described, by way of example only, with reference to the accompanying drawings.

Figure 1:
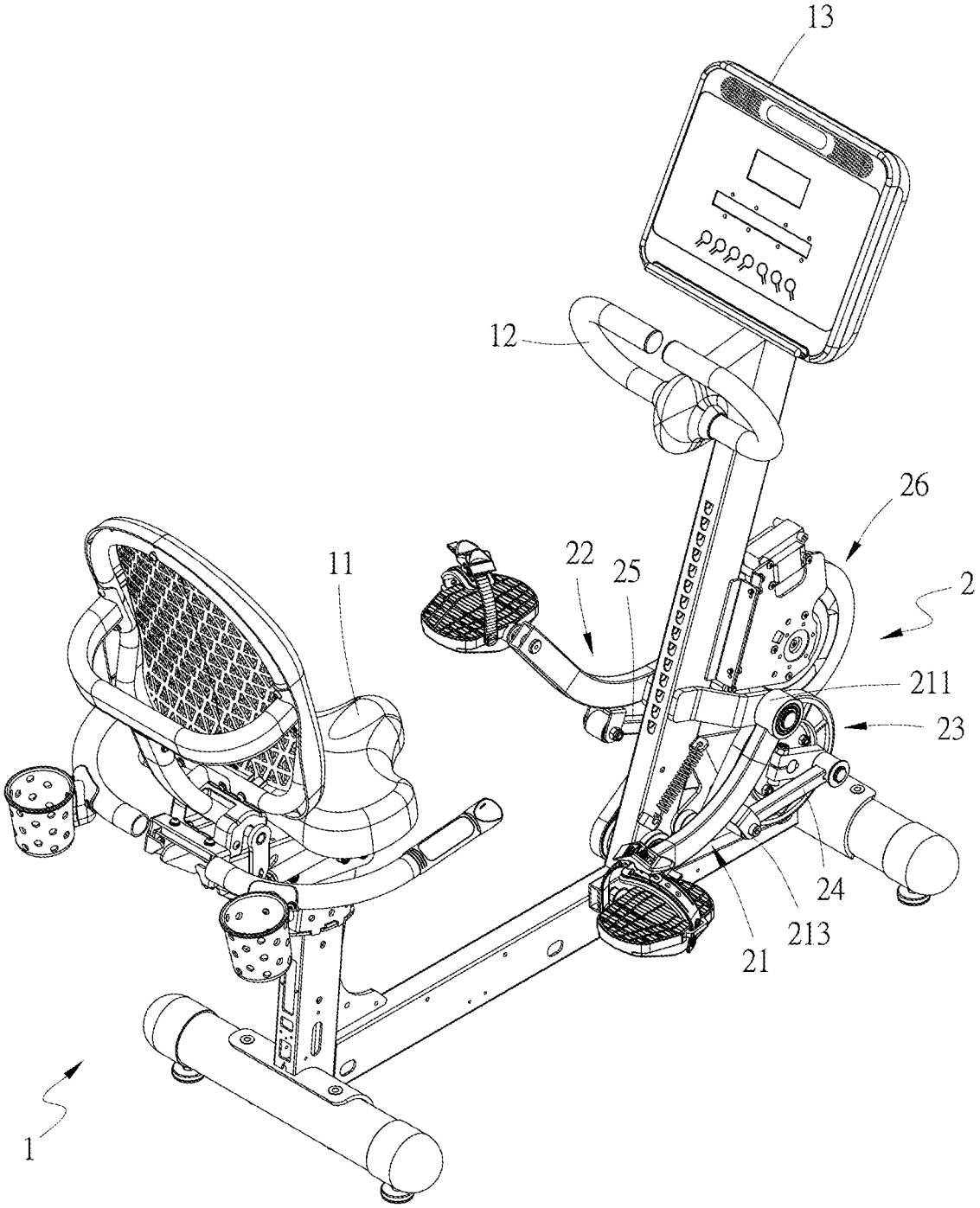
FIG. 1 is a perspective view according to an embodiment of the present invention.
Figure 1A:
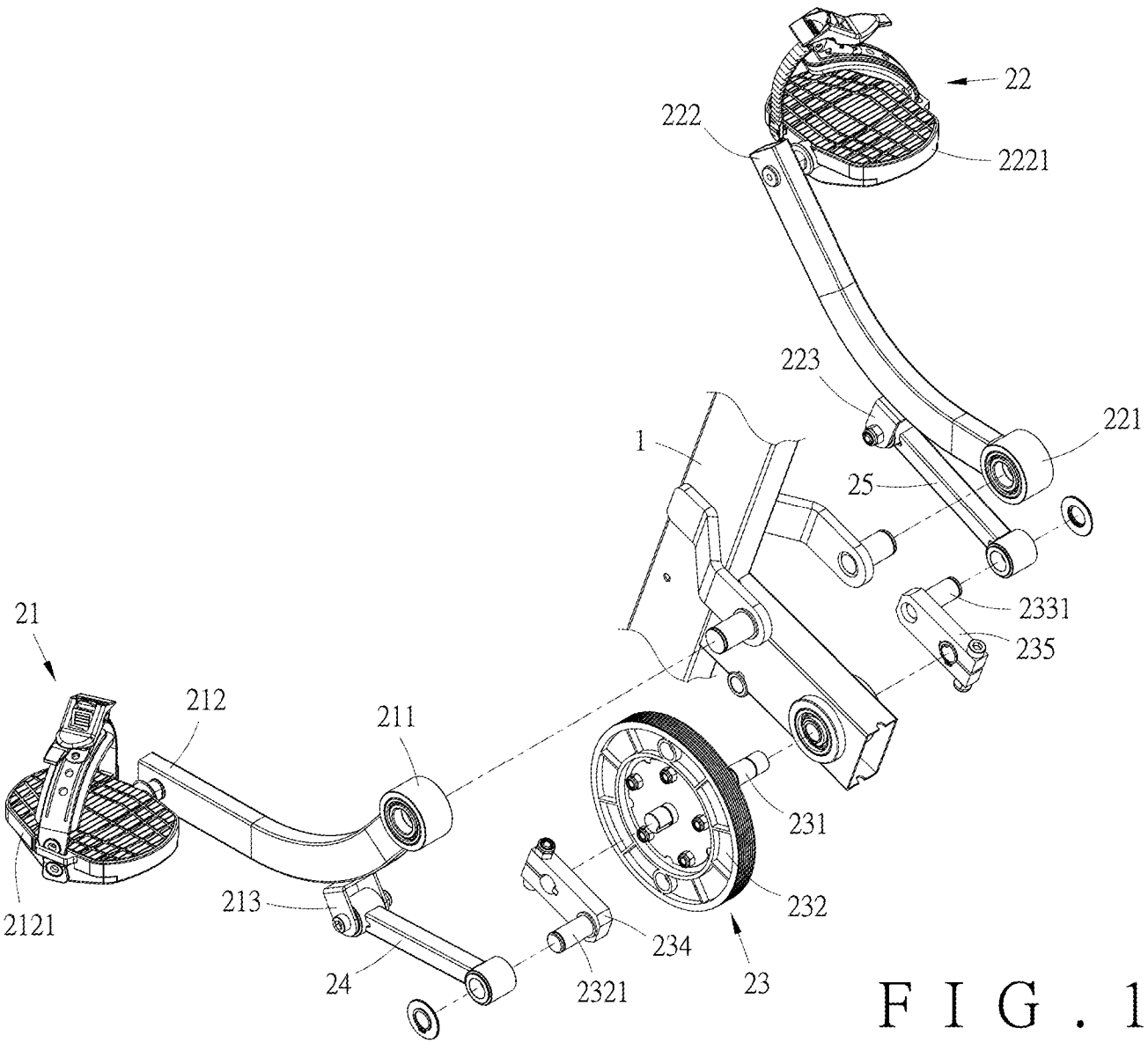
FIG. 1A is an exploded view according to the embodiment of the present invention.

FIG. 1 illustrates a reciprocating transmission structure of an exercise machine according to an embodiment of the present invention. The reciprocating transmission structure 2 is mounted to a frame 1 of the exercise machine. In the embodiment of the present invention, the exercise machine is an exercise bike. The frame 1 may be provided with a seat 11, a grip 12, a screen 13, and so on.

Referring to FIG. 1, FIG. 1A, FIG. 2 and FIG. 3, the reciprocating transmission structure 2 of the exercise machine comprises a first reciprocating member 21, a second reciprocating member 22, a main rotating wheel 23, and a first link 24, a second link 25, a resistance wheel 26, a first rotating wheel 27, a second rotating wheel 28, and a third rotating wheel 29. The screen 13 is configured to display the parameters, such as the user's exercise time, the resistance of the resistance wheel 26, and so on. The screen 13 may be a touch screen, allowing the user to directly manipulate the screen 13 for adjusting the resistance of the resistance wheel 26, etc. However, this part is not the improved feature of the present invention, so this part is not described in detail.

The first reciprocating member 21 includes a first reciprocating pivot portion 211 and a first force-receiving portion 212 that are located away from each other. The first reciprocating pivot portion 211 is pivotally connected to the frame 1. A first pivot portion 213 is provided between the first reciprocating pivot portion 211 and the first force-receiving portion 212. The second reciprocating member 22 includes a second reciprocating pivot portion 221 and a second force-receiving portion 222 that are located away from each other. The second reciprocating pivot portion 221 is pivotally connected to the frame 1. A second pivot portion 223 is provided between the second reciprocating pivot portion 221 and the second force-receiving portion 222. The first force-receiving portion 212 includes a first operating member 2121. The first operating member 2121 is pivotally connected to the first reciprocating member 21. The second force-receiving portion 222 includes a second operating member 2221. The second operating member 2221 is pivotally connected to the second reciprocating member 22.

The main rotating wheel 23 is pivotally connected to the frame 1 through a rotating shaft 231. The main rotating wheel 23 includes a first face 232 and an opposing second face 233. The first face 232 is provided with a first face pivot portion 2321 at a position away from the rotating shaft 231. The second face 233 is provided with a second face pivot portion 2331 at a position away from the rotating shaft 231. A first end of the rotating shaft 231 extends out of the first face 232. The first end is secured to one end of a first arm 234. The first arm 234 extends in the radial direction of the main rotating wheel 23. The other end of the first arm 234 is formed with the first face pivot portion 2321. A second end of the rotating shaft 231 extends out of the second face 233. The second end is secured to one end of a second arm 235. The second arm 235 extends in the radial direction of the main rotating wheel 23. The other end of the second arm 235 is formed with the second face pivot portion 2331. An included angle between the first arm 234 and the second arm 235 in the radial direction of the main rotating wheel 23 is between 0° and 180°. In the embodiment of the present invention, the included angle is 180 degrees. In actual implementation, it may be adjusted to 0 degrees or other angles to meet the needs of a different user (the user is not shown in the drawing).

One end of the first link 24 is pivotally connected to the first pivot portion 213, and the other end of the first link 24 is directly or indirectly pivoted to the first face pivot portion 2321. One end of the second link 25 is pivotally connected to the second pivot portion 223, and the other end of the second link 25 is directly or indirectly pivoted to the second face pivot portion 2331. The resistance wheel 26 is pivotally connected to the frame 1. The resistance wheel 26 is directly or indirectly driven by the main rotating wheel 23.

The first rotating wheel 27 and the second rotating wheel 28 are coaxially pivoted to the frame 1. The main rotating wheel 23 drives the first rotating wheel 27 through a first belt 271. The second rotating wheel 28 drives the third rotating wheel 29 through a second belt 281. The third rotating wheel 29 and the resistance wheel 26 are coaxially pivoted to the frame 1.

The resistance wheel 26 includes a resistance member 261. The resistance member 261 is a magnetic resistance member or a friction member. The resistance member 261 acts on the resistance wheel 26 to generate a resistance. Through the magnetic resistance member or the friction member, the adjustment for a desired resistance is easier. In actual implementation, the resistance wheel 26 may be a wind resistance wheel.

Figure 4:
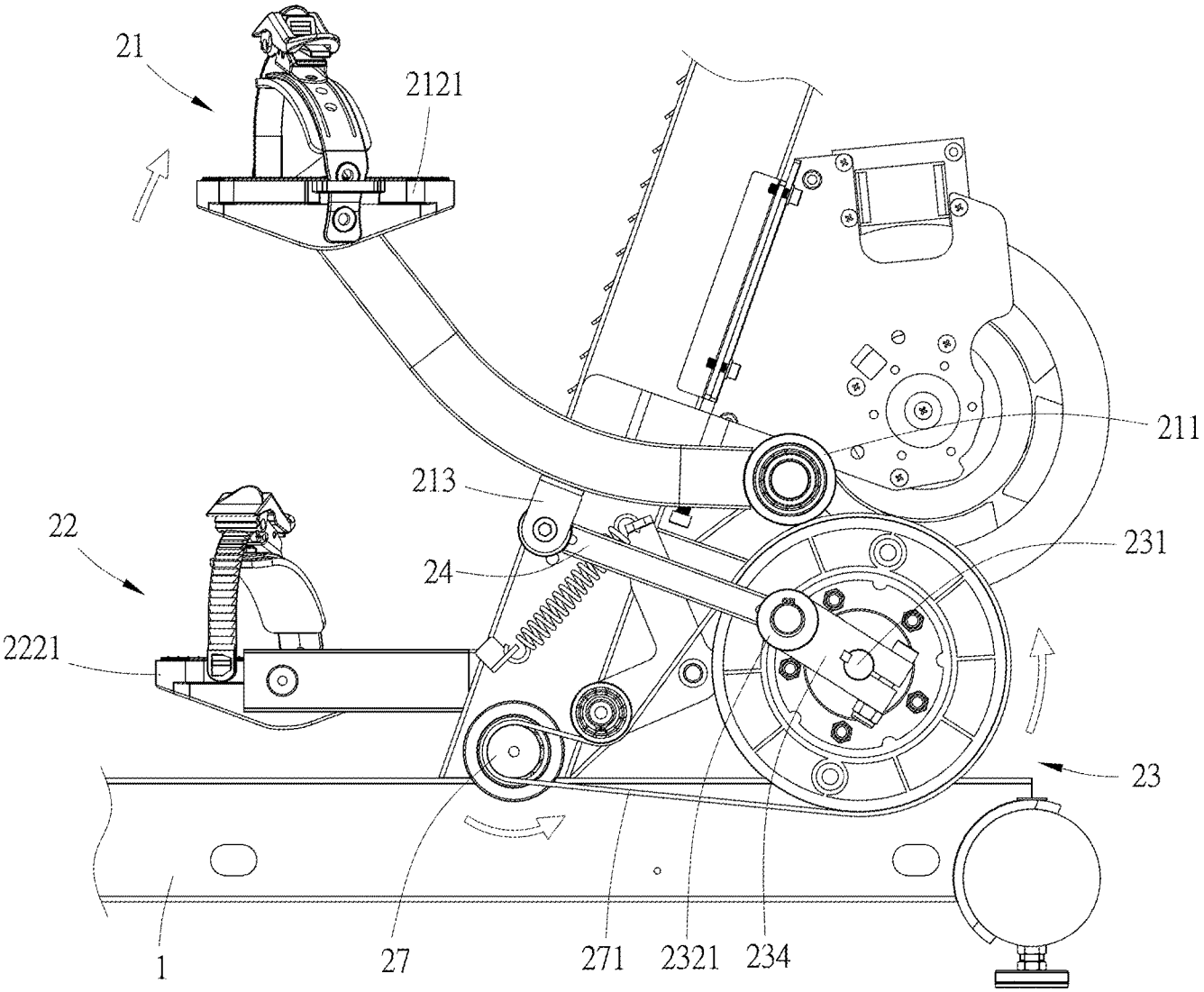
FIG. 4 is a first schematic view of the operation of the embodiment of the present invention, showing that the first reciprocating member drives the main rotating wheel to rotate through the first link, and then the main rotating wheel drives the first rotating wheel to rotate.
Figure 5:
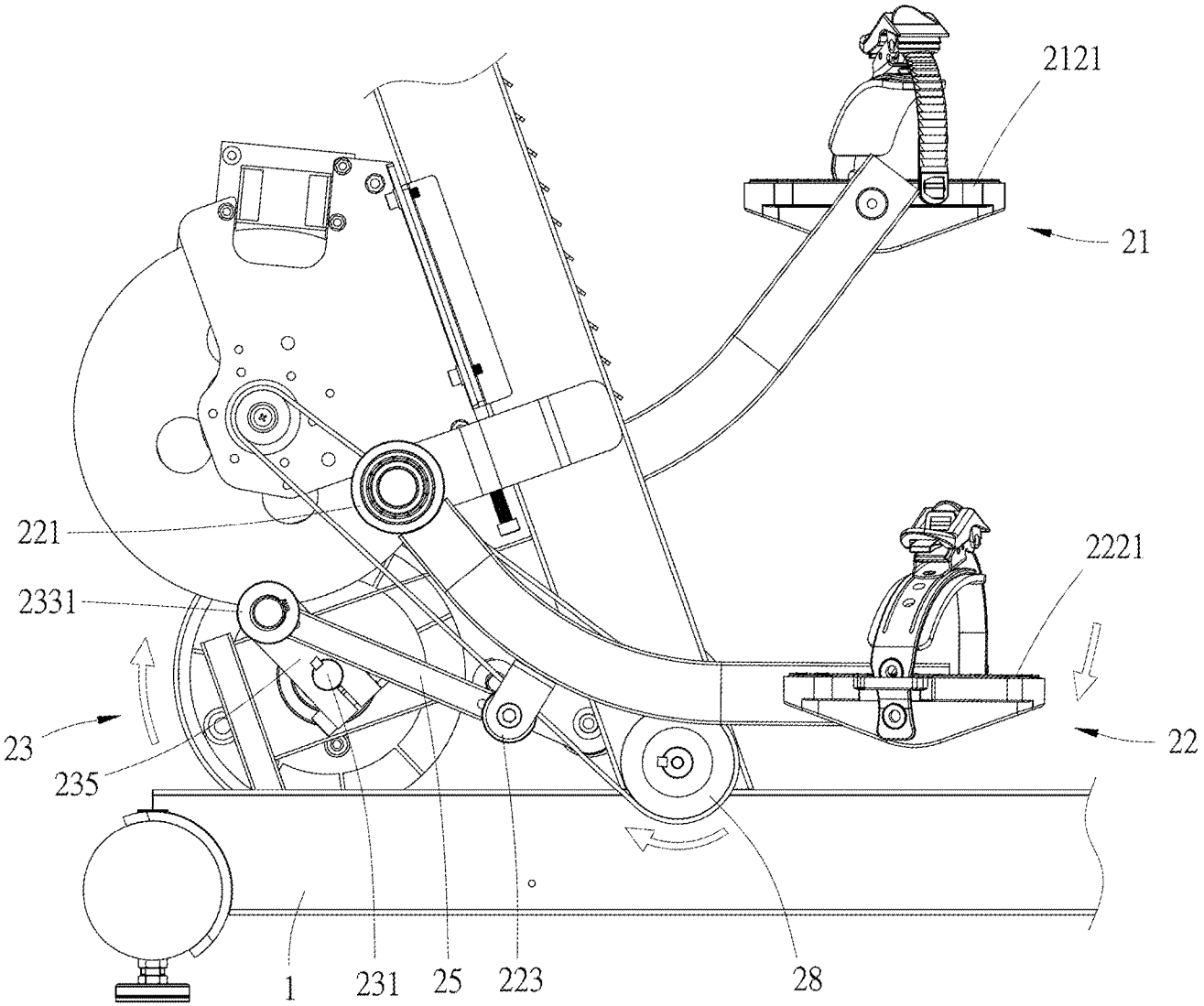
FIG. 5 is a second schematic view of the operation of the embodiment of the present invention, showing that the second reciprocating member drives the main rotating wheel to rotate through the second link, the main rotating wheel drives the first rotating wheel to rotate, and the second rotating wheel rotates synchronously with the first rotating wheel.

Referring to FIG. 1, FIG. 4 and FIG. 5, when in use, the user rides on the seat 11, grasps the grip 12 with both hands, and extends both feet into the first operating member 2121 and the second operating member 2221. Since the first operating member 2121 and the second operating member 2221 are foot pedals with straps, the tightness of the straps can be adjusted according to the user's feet. This is convenient for the user to operate. If the user feels uncomfortable, the frame can be adjusted to change the height of the seat 11 so that the user can exercise comfortably.

Figure 2:
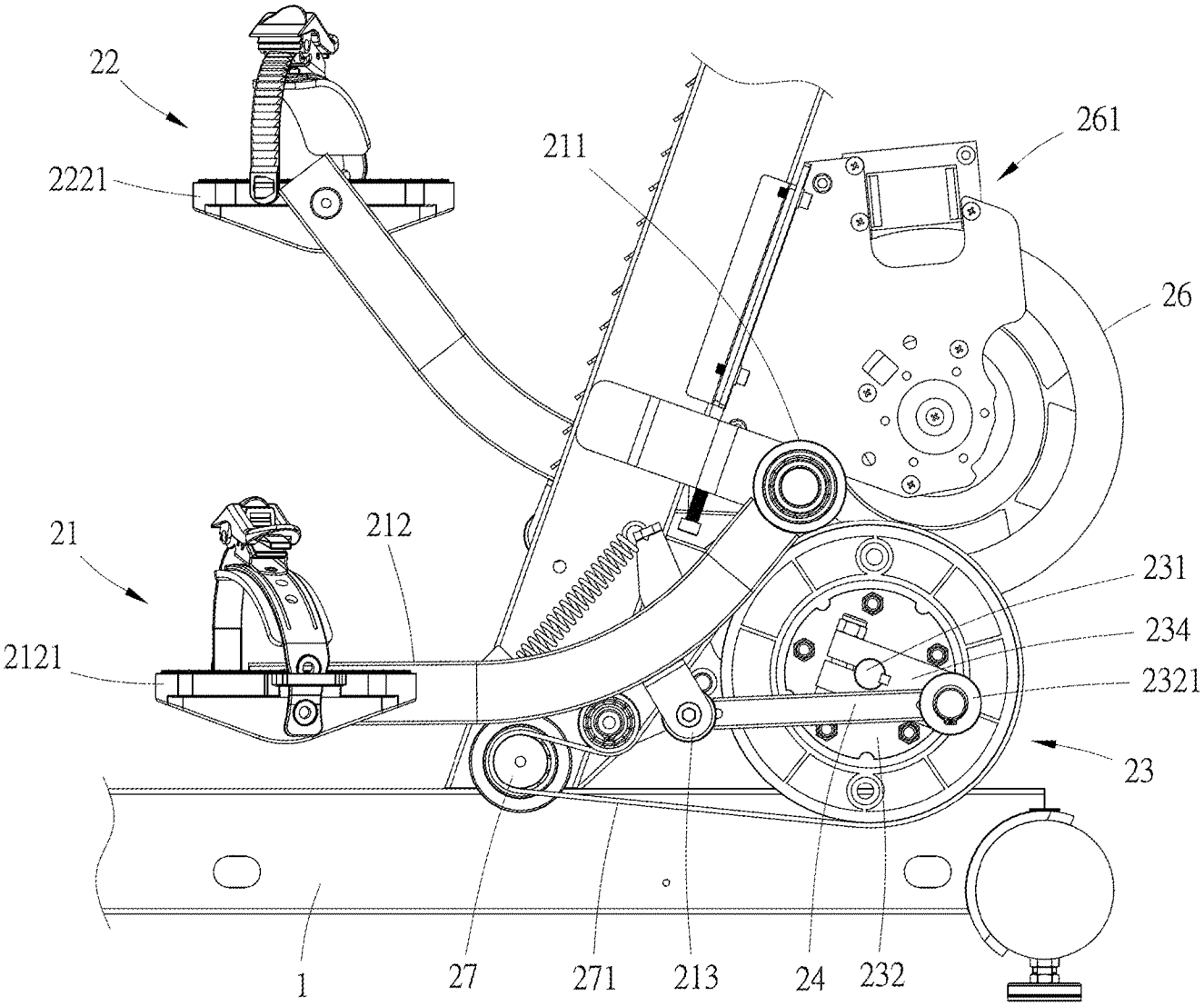
FIG. 2 is a side view according to the embodiment of the present invention.
Figure 3:
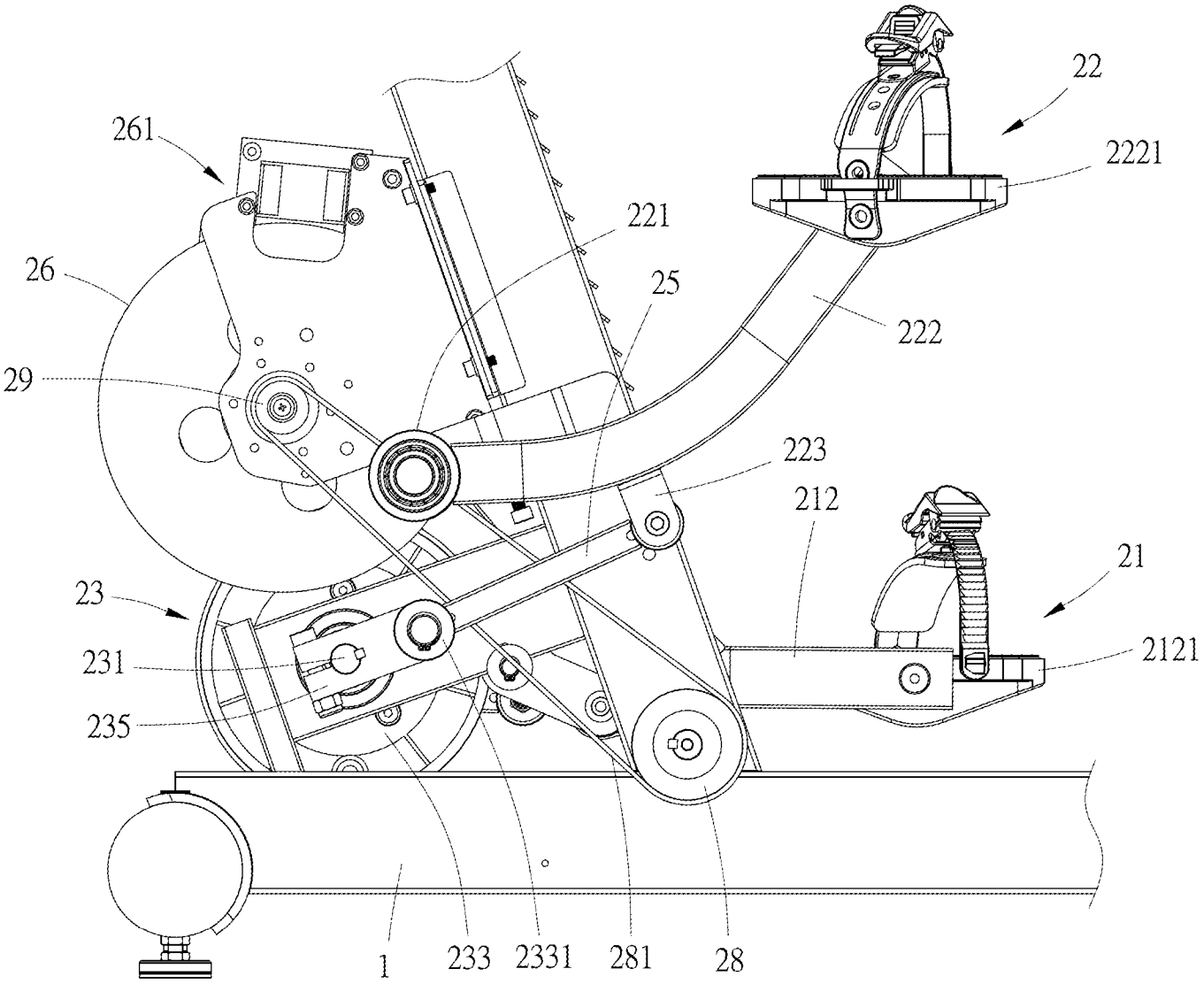
FIG. 3 is another side view according to the embodiment of the present invention.

After all adjustments are completed, the user's both feet can apply force on the first operating member 2121 of the first reciprocating member 21 and the second operating member 2221 of the second reciprocating member 22 in reverse. The first reciprocating member 21 is located on the right side of the user, and the second reciprocating member 22 is located on the left side of the user. Assuming that in the original state (that is, when the user has not exerted any force as shown in FIG. 2 and FIG. 3), the first operating member 2121 is lower than the second operating member 2221. After the user exerts force, the second operating member 2221 is pressed down by the user's left foot, and the first operating member 2121 is driven up by the user's right foot.

When the first operating member 2121 is driven up by the user, the first reciprocating member 21 will reciprocate upward with the first reciprocating pivot portion 211 as its axis. After the first reciprocating member 21 moves upward, the first pivot portion 213 is also driven upward. After the first link 24 pivotally connected to the first pivot portion 213 is driven by the first pivot portion 213, the first link 24 drives the first face pivot portion 2321 to approach the first reciprocating member 21, so that the main rotating wheel 23 is driven by the first arm 234 to rotate with the rotating shaft 231 as its axis. Because the main rotating wheel 23 drives the first rotating wheel 27 through the first belt 271, after the main rotating wheel 23 rotates, the first rotating wheel 27 also rotates.

When the second operating member 2221 is pressed down, the second reciprocating member 22 will reciprocate downward with the second reciprocating pivot portion 221 as its axis. After the second reciprocating member 22 moves downward, the second pivot portion 223 is also driven downward. After the second link 25 pivotally connected to the second pivot portion 223 is driven by the second pivot portion 223, the second link 25 drives the second face pivot portion 2331 to move away from the second reciprocating member 22. The main rotating wheel 23 is driven by the second arm 235 to increase the power to rotate with the rotating shaft 231 as its axis. Since the first rotating wheel 27 and the second rotating wheel 28 are coaxially pivoted to the frame 1, when the first rotating wheel 27 rotates, the second rotating wheel 28 also rotates synchronously.

Figure 6:
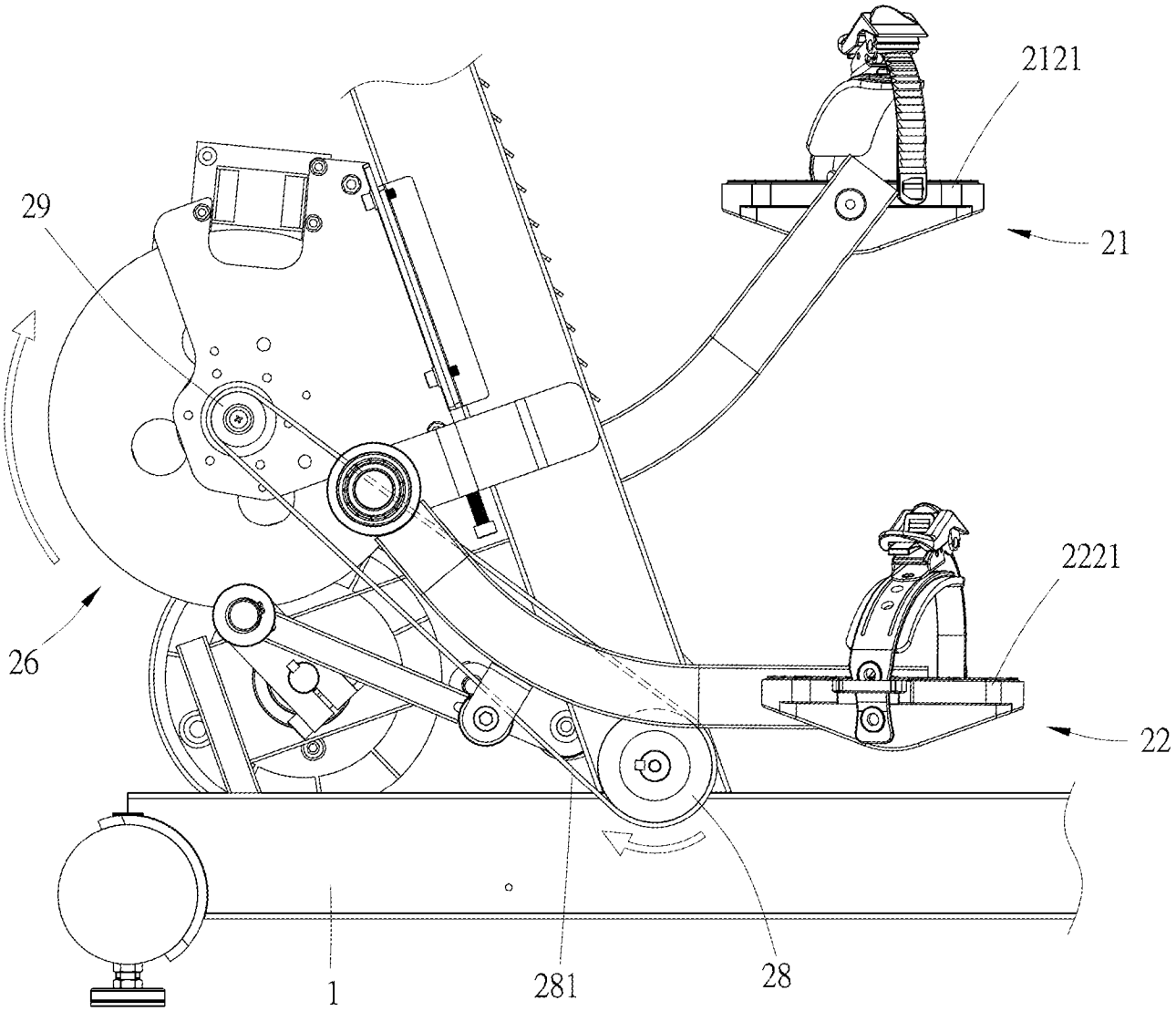
FIG. 6 is a third schematic view of the operation of the embodiment of the present invention, showing that after the second rotating wheel rotates, the third rotating wheel is driven by the second rotating wheel to drive the resistance wheel to rotate.

Referring to FIG. 5 and FIG. 6, because the second rotating wheel 28 drives the third rotating wheel 29 through the second belt 281, after the second rotating wheel 28 rotates, the third rotating wheel 29 will also rotate. Because the third rotating wheel 29 and the resistance wheel 26 are coaxially pivoted to the frame 1, when the third rotating wheel 29 rotates, the resistance wheel 26 also rotates synchronously, so that the user can enhance the intensity of exercise through the resistance provided by the resistance wheel 26.

Please refer to FIG. 2 and FIG. 3 again. The user exerts force once again. The first operating member 2121 is pressed down by the user's right foot, and the second operating member 2221 is driven up by the user's left foot. Therefore, the first reciprocating member 21 moves downward, and the second reciprocating member 22 moves upward. After the first reciprocating member 21 moves downward, the first link 24 is driven by the first pivot portion 213, and the first link 24 drives the first face pivot portion 2321 to move toward the first reciprocating member 21, so that the main rotating wheel 23 is driven by the first arm 234 to rotate with the rotating shaft 231 as its axis. After the second reciprocating member 22 moves upward, the second link 25 is driven by the second pivot portion 223, and the second link 25 drives the second face pivot portion 2331 to approach the second reciprocating member 22. The main rotating wheel 23 is driven by the second arm 235 to increase the power to rotate with the rotating shaft 231 as its axis. After the main rotating wheel 23 rotates, the first rotating wheel 27, the second rotating wheel 28 and the third rotating wheel 29 drive the resistance wheel 26 to rotate, so that the user can enhance the intensity of exercise through the resistance provided by the resistance wheel 26.

Please refer to FIG. 1, FIG. 2 and FIG. 3 again. No matter whether the resistance wheel 26 includes the resistance member 261 or the resistance wheel 26 is directly the wind resistance wheel, it can provide the user with sufficient resistance for the user to choose a desired resistance according to his/her needs. Besides, because the resistance wheel 26 is provided, after the user operates the first reciprocating member 21 and the second reciprocating member 22 for reciprocating movement, through the coordinated transmission of the components of the reciprocating transmission structure 2 of the exercise machine, the resistance wheel 26 is driven to rotate, thereby enhancing the intensity of exercise and satisfying the user who needs a stronger intensity of exercise.

Since the first reciprocating member 21 and the second reciprocating member 22 perform reciprocating movement and drive the main rotating wheel 23 to rotate through the reciprocating movement, the exercise machine is suitable for performing exercises related to reciprocating movement, such as reciprocating leg exercise or reciprocating arm exercise. In particular, the aforementioned reciprocating movement is transmitted to the main rotating wheel 23. The reciprocating movement is converted into a rotary motion. Then, the main rotating wheel 23 transmits power to the resistance wheel 26. The resistance of the resistance wheel 26 can be easily controlled by means of friction resistance, magnetic resistance, wind resistance, etc., making the operation easier.

In the above embodiment, when the included angle between the first arm 234 and the second arm 235 is 0 degrees, the first reciprocating member 21 and the second reciprocating member 22 reciprocate synchronously. When the included angle between the first arm 234 and the second arm 235 is 180 degrees, the first reciprocating member 21 and the second reciprocating member 22 reciprocate alternately. When the included angle between the first arm 234 and the second arm 235 is greater than 0 degrees and less than 180 degrees, the first reciprocating member 21 and the second reciprocating member 22 reciprocate alternately and asymmetrically.

The exercise machine of the above-mentioned embodiments is an exercise bike as an example, but the present invention may be applied to other types of exercise machines.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A reciprocating transmission structure of an exercise machine, mounted to a stationary frame of the exercise machine, comprising:

a first reciprocating member and a second reciprocating member each configured to perform a reciprocating vertical motion in a respective vertical plane parallel to a longitudinal axis of the stationary frame;

the first reciprocating member being configured with a first operating member, a single first reciprocating pivot portion, and a single first force-receiving portion spaced apart from the single first reciprocating pivot portion and pivotally coupled to the first operating member at a single pivotal point, the single first reciprocating pivot portion being installed on a shaft directly coupled to the stationary frame, thus forming a direct pivotal connection between the single first reciprocating pivot portion and the stationary frame, wherein a first pivot portion is provided between the single first reciprocating pivot portion and the single first force-receiving portion;

the second reciprocating member being configured with a second operating member, a single second reciprocating pivot portion, and a single second force-receiving portion spaced apart from the single second reciprocating pivot portion and pivotally coupled to the second operating member at a single pivotal point, the single second reciprocating pivot portion being installed on a second shaft directly coupled to the stationary frame, thus forming a direct pivotal connection between the single second reciprocating pivot portion and the stationary frame, wherein a second pivot portion is provided between the single second reciprocating pivot portion and the single second force-receiving portion;

a main rotating wheel pivotally connected to the stationary frame through a rotating shaft, the main rotating wheel including a first face and an opposing second face, the first face being provided with a first face pivot portion at a position away from the rotating shaft, the second face being provided with a second face pivot portion at a position away from the rotating shaft;

a first link, one end of the first link being pivotally connected to the first pivot portion, and another end of the first link being directly or indirectly pivoted to the first face pivot portion;

a second link, one end of the second link being pivotally connected to the second pivot portion, and another end of the second link being directly or indirectly pivoted to the second face pivot portion; and a resistance wheel, pivotally connected to the stationary frame, the resistance wheel being directly or indirectly driven by the main rotating wheel;

wherein the single first reciprocating member reciprocally moves with the single first reciprocating pivot portion as an axis thereof, wherein the single second reciprocating member reciprocally moves with the single second reciprocating pivot portion as an axis thereof, wherein the first link and the second link drive the main rotating wheel to rotate with the rotating shaft as an axis thereof, and wherein the main rotating wheel drives the resistance wheel to rotate.

2. The reciprocating transmission structure of the exercise machine as claimed in claim 1, wherein a first end of the rotating shaft extends out of the first face, the first end is secured to one end of a first arm, the first arm extends in a radial direction of the main rotating wheel, another end of the first arm is formed with the first face pivot portion, a second end of the rotating shaft extends out of the second face, the second end is secured to one end of a second arm, the second arm extends in the radial direction of the main rotating wheel, another end of the second arm is formed with the second face pivot portion.

3. The reciprocating transmission structure of the exercise machine as claimed in claim 2, wherein an included angle between the first arm and the second arm in the radial direction of the main rotating wheel is between or including 0° and 180°.

4. The reciprocating transmission structure of the exercise machine as claimed in claim 1, further comprising a first rotating wheel and a second rotating wheel that are coaxially pivoted to the frame to rotate synchronously, the main rotating wheel driving the first rotating wheel through a first belt, the second rotating wheel driving a third rotating wheel through a second belt, the third rotating wheel and the resistance wheel being coaxially pivoted to the frame to rotate synchronously.

5. The reciprocating transmission structure of the exercise machine as claimed in claim 1, wherein the single first force-receiving portion includes the first operating member, wherein the first operating member is pivotally connected to the single first reciprocating member, wherein the single second force-receiving portion includes the second operating member, and wherein the second operating member is pivotally connected to the single second reciprocating member.

6. The reciprocating transmission structure of the exercise machine as claimed in claim 1, wherein the resistance wheel includes a resistance member, the resistance member is a magnetic resistance member or a friction member, and the resistance member acts on the resistance wheel to generate a resistance.

7. The reciprocating transmission structure of the exercise machine as claimed in claim 1, wherein the resistance wheel is a wind resistance wheel.

* * * * *